US008141273B2

(12) United States Patent
Stramare et al.

(10) Patent No.: US 8,141,273 B2
(45) Date of Patent: Mar. 27, 2012

(54) SHOE WITH DIRECTIONAL CONDITIONING DEVICE FOR LACES OR THE LIKE

(75) Inventors: Sergio Stramare, Segusino (IT); Marco Breda, Arcade (IT)

(73) Assignee: Tecnica SpA, Giavera del Montello (IT)

( * ) Notice: Subject to any disclaimer, the term of this patent is extended or adjusted under 35 U.S.C. 154(b) by 925 days.

(21) Appl. No.: 12/093,363

(22) PCT Filed: Nov. 15, 2005

(86) PCT No.: PCT/IT2005/000664

§ 371 (c)(1),
(2), (4) Date: May 12, 2008

(87) PCT Pub. No.: WO2007/057926

PCT Pub. Date: May 24, 2007

(65) Prior Publication Data

US 2008/0250618 A1 Oct. 16, 2008

(51) Int. Cl.

| | |
|---|---|
| ***A43C 11/00*** | (2006.01) |
| ***A43C 7/08*** | (2006.01) |
| ***A43C 7/04*** | (2006.01) |
| ***A43B 5/04*** | (2006.01) |
| ***D06F 53/00*** | (2006.01) |
| ***D06F 53/04*** | (2006.01) |
| ***F16G 11/10*** | (2006.01) |

(52) U.S. Cl. ..... 36/50.1; 36/50.5; 24/712.5; 24/712.6; 24/134 P

(58) Field of Classification Search ..... 36/50.1, 36/50.5, 51, 54; 24/712.6, 712.1, 712.7, 24/712.5, 712.2, 134 P, 134 R, 132 R, 134 KB, 24/134 N, 136 K; 114/218
See application file for complete search history.

(56) References Cited

U.S. PATENT DOCUMENTS 1,486,507 A * 3/1924 Walker ..... 24/134 P
(Continued)

FOREIGN PATENT DOCUMENTS

DE 102 38 025 A1 8/2003
(Continued)

OTHER PUBLICATIONS

International Search Report for PCT International Application No. PCT/IT2005/000664 mailed Jul. 19, 2006.

*Primary Examiner* — Jila Mohandesi
*Assistant Examiner* — Melissa Lalli
(74) *Attorney, Agent, or Firm* — RatnerPrestia

(57) ABSTRACT

A footwear item including an upper portion; at least one lace passing through eyelets arranged along the edges of an opening on the front the upper portion, and that tightens, thereby drawing the edges of the opening closer to each other, when pulled in a fastening direction; a string locking arrangement, provided in the upper portion having one or more passages in which the at least one lace is inserted and is capable of sliding when the wearer pulls it, while being capable of being retained there by a lock when it is at rest. The lock including an oscillating locking member in contact with the at least one lace to slide when the latter is pulled in the fastening direction, and which gets attached onto the at least one lace and locks it in position when the latter undergoes a tension in a direction opposite to the fastening direction.

16 Claims, 5 Drawing Sheets

U.S. PATENT DOCUMENTS

| | | | | | |
|---|---|---|---|---|---|
| 2,315,196 | A | * | 3/1943 | Gallione | 248/499 |
| 3,564,670 | A | | 2/1971 | Bengtsson | |
| 3,953,114 | A | | 4/1976 | Bidgood | |
| 4,261,081 | A | * | 4/1981 | Lott | 24/712.2 |
| 4,766,835 | A | * | 8/1988 | Randall et al. | 114/218 |
| 4,899,423 | A | * | 2/1990 | Randall | 24/134 R |
| 5,158,428 | A | | 10/1992 | Gessner et al. | |
| 5,477,593 | A | * | 12/1995 | Leick | 24/712.5 |
| 5,852,853 | A | * | 12/1998 | Pennoyer, Jr. | 24/134 P |
| 5,996,256 | A | * | 12/1999 | Zebe, Jr. | 36/50.1 |
| 6,076,241 | A | | 6/2000 | Borel | |
| 6,339,867 | B1 | * | 1/2002 | Azam | 24/712.5 |
| 6,729,000 | B1 | | 5/2004 | Liu | |
| 6,775,928 | B2 | * | 8/2004 | Grande et al. | 36/50.1 |
| 7,231,699 | B2 | * | 6/2007 | Borsoi | 24/712.5 |
| 7,360,282 | B2 | * | 4/2008 | Borsoi | 24/136 R |
| 2003/0226284 | A1 | | 12/2003 | Grande et al. | |
| 2004/0000036 | A1 | | 1/2004 | Sartor et al. | |
| 2005/0097780 | A1 | | 5/2005 | Pellegrini | |

FOREIGN PATENT DOCUMENTS

| | | | |
|---|---|---|---|
| EP | 1 112 697 | A1 | 7/2001 |
| EP | 1 541 049 | A2 | 6/2005 |
| FR | 2 847 129 | | 5/2004 |
| FR | 2 871 345 | | 12/2005 |

* cited by examiner

SHOE WITH DIRECTIONAL CONDITIONING DEVICE FOR LACES OR THE LIKE

This application is a U.S. National Phase Application of PCT International Application No. PCT/IT2005/000664, filed Nov. 15, 2005.

The present invention refers to a footwear item provided with a locking arrangement for strings, laces or similar means, as used in particular for fastening boots.

For reasons of greater simplicity, reference will be made to just the case of boots throughout the following description, even if the object of the invention is may be integrated in other footwear items.

BACKGROUND OF THE INVENTION

Except for the case in which boots are adapted to be fastened by means of buckles or Velcro® strips, they are generally provided with strings or laces. Such strings, usually in the number of one or—at the most—two, extend along a zigzag path on the boot as they are routed at sharp alternate turns through a number of traction eyelets attached along the two adjacent borders of an aperture provided in the boot, usually in the front portion thereof, where the foot is inserted (see for instance EP 1 541 049). When a string is then pulled, this is caused to slide through the eyelets, thereby pulling the borders of said aperture closer to each other and, ultimately, closing said aperture.

Described in U.S. Pat. No. 6,076,241 is a locking arrangement for strings or laces, in which there are provided two guides with a U-shaped cross-section, in which two strings, i.e. a string for each guide, can be inserted and pulled parallelly along a traction direction. To lock the strings in position, the need arises then for said strings to be bent towards each other, so that a toothing provided in the upper portion of each guide is able to engage the respective string, thereby locking it. This however requires a quite inconvenient and unnatural movement to be performed by the wearer, since he/she has to cross his/her arms above the foot while keeping the strings tight and stretched.

EP 1 112 697 discloses a fastening arrangement, in which two ends of a string extending in a zigzag pattern all along the instep, i.e. the arched upper part of the foot in the boot, slip into a double guide tunnel that is oriented along the longitudinal axis of the foot, and terminate into a clevis. In this way, the wearer is able to seize the clevis by remaining in an almost erect posture, and pull it to thereby tighten the string around the foot. However, the string must then be locked in the desired position by using another appropriate contrivance, otherwise it would slide backwards and slacken, thereby undoing the fastening effect of the boot. It may be readily appreciated that it is quite inconvenient for the wearer to have to stretch the string, i.e. keep it tight, and lock it at the same time onto the boot, since he/she must stoop to do this. Moreover, apart from this adding some complications to the string locking arrangement itself, the need arises here to provide a kind of "case" in the boot, where the clevis can be accommodated and retained, so that it does not get in the way, i.e. is not of hindrance during normal use of the boot.

The string locking arrangement disclosed in US 2005/0097780 is provided on the front tongue of the boot and is formed of a mushroom-shaped protrusion, under which one or more strings are run to fit in and be retained under pressure by projecting teeth so as to effectively prevent them from sliding. For the boot to be fastened, the string must be pulled sideways relative to the foot, be run under the protrusion, and finally be pulled upwards. In this way, the string is caused to be trapped and locked up by the teeth. Anyway, having to pull the string—or, still worse, a couple of strings—by exerting a force sideways relative to the foot, is not really something that can be done in a much convenient manner.

Described in DE 102 38 025 is again a locking arrangement for the fastening strings of a boot. This arrangement is formed of a kind of grooved boss, in the groove of which there are provided projecting ribs in the shape of a V having its vertex facing the bottom of the rib. The string can wedge itself in the vertex of the V-shaped ribs, thereby remaining locked therein, or slide thereabove when it is at a standstill and is being pulled, respectively. The effects of a variation in the tension on the string are boosted by the provision of an elbow-shaped rebound provided in the route followed by the string as determined by the narrow radius of curvature of the groove. Now, for the entire boot to be duly fastened, a plurality of devices such as the one described above are needed, actually, and the string must be run, i.e. passed by hand through each one of them—one by one.

Other string locking arrangements, which are conceptually similar to the above-described one, are described in U.S. Pat. No. 5,158,428 and FR 2 847 129. In these cases use is made of loops in which there are provided fixed retaining teeth projecting therefrom, which are effective in retaining the string when—by assuming a particular mutual arrangement—they come into engaging the same string.

Known in the art are also a number of further string locking arrangements, such as for instance the ones disclosed in U.S. Pat. No. 3,953,114 or U.S. Pat. No. 3,564,670, in which use is made of a kind of key or a moving retaining tooth to lock the string onto a guide thereof. Further to being quite complicated, these arrangements require the wearer to perform an additional operation in that he/she—further to pull the strings—has in fact to also lock them in position.

BRIEF DESCRIPTION OF THE INVENTION

The present invention provides a footwear item with a locking arrangement for the strings, or similar fastening means, in particular for boots, which does away with the drawbacks encountered in prior-art arrangements.

According to the present invention, this aim is reached in a footwear item comprised of:

- an upper portion that reaches up to at least the ankle;
- at least one string or lace that runs through eyelets arranged along the edges of an opening up on the front of the footwear item, and that tightens up, thereby drawing the edges of said opening closer to each other, when it is pulled in a fastening direction;
- a string guide arrangement, provided in the upper portion of the boot, having one or more passages through which said string is led, and in which said string is capable of sliding when the wearer pulls it, while being capable of being retained there by locking means when it is at rest, i.e. not pulled in the fastening direction, characterized in that said locking means are comprised of an oscillating locking member in contact with said at least one string which allows said at least one string to slide when the latter is pulled in the fastening direction, and which on the contrary gets stuck onto said at least one string and locks it in position when the latter undergoes a tension in a direction opposite to the fastening one.

With a footwear item according to the invention, when the string is eventually pulled to the desired extent of tightness, which may occur either in a single go or in several successive steps, the string is locked in position and the footwear items fastened in a stable and reliable manner without being slacked by the return tension of the string. In addition, it is the sole movement of the strings that actuates the locking means, actually, so that the wearer can use just a single hand to fasten the footwear item.

The locking means are provided with a quite simple and user-friendly construction based on an oscillating locking member, which is in contact with said at least one string and allows said at least one string to slide when the latter is pulled in the fastening direction, while wedging onto said at least one string to thereby keeping it locked in position when a tension is applied onto it in the direction opposite to the fastening one.

A further advantage is obtained if said oscillating member is elastically biased, for example by spring means or directly by a flexible segment provided integrally therewith. The result is that, in fact, the pressure exerted onto the string is boosted and, above all, the oscillating member is kept—substantially constantly—in contact with the string, regardless of its being at a standstill or sliding, so that both the accuracy and the reliability of the unidirectional string guide arrangement are clearly enhanced (for example, the string cannot twist or tangle up).

In view of further improving the gripping effectiveness of the oscillating member, it may be provided with properly projecting teeth.

Although the string locking means may be provided outside the passages of the (unidirectional) string guide arrangement, they may also be integrated in said passages for such arrangement to be made more compact, lightweight and easily controllable.

BRIEF DESCRIPTION OF THE DRAWINGS

Features and advantages of a footwear item according to the present invention may anyway be more readily and fully understood from the description of a boot that is given below by way of example with reference to the accompanying drawings, in which.

DETAILED DESCRIPTION OF THE INVENTION

Figure 1A:
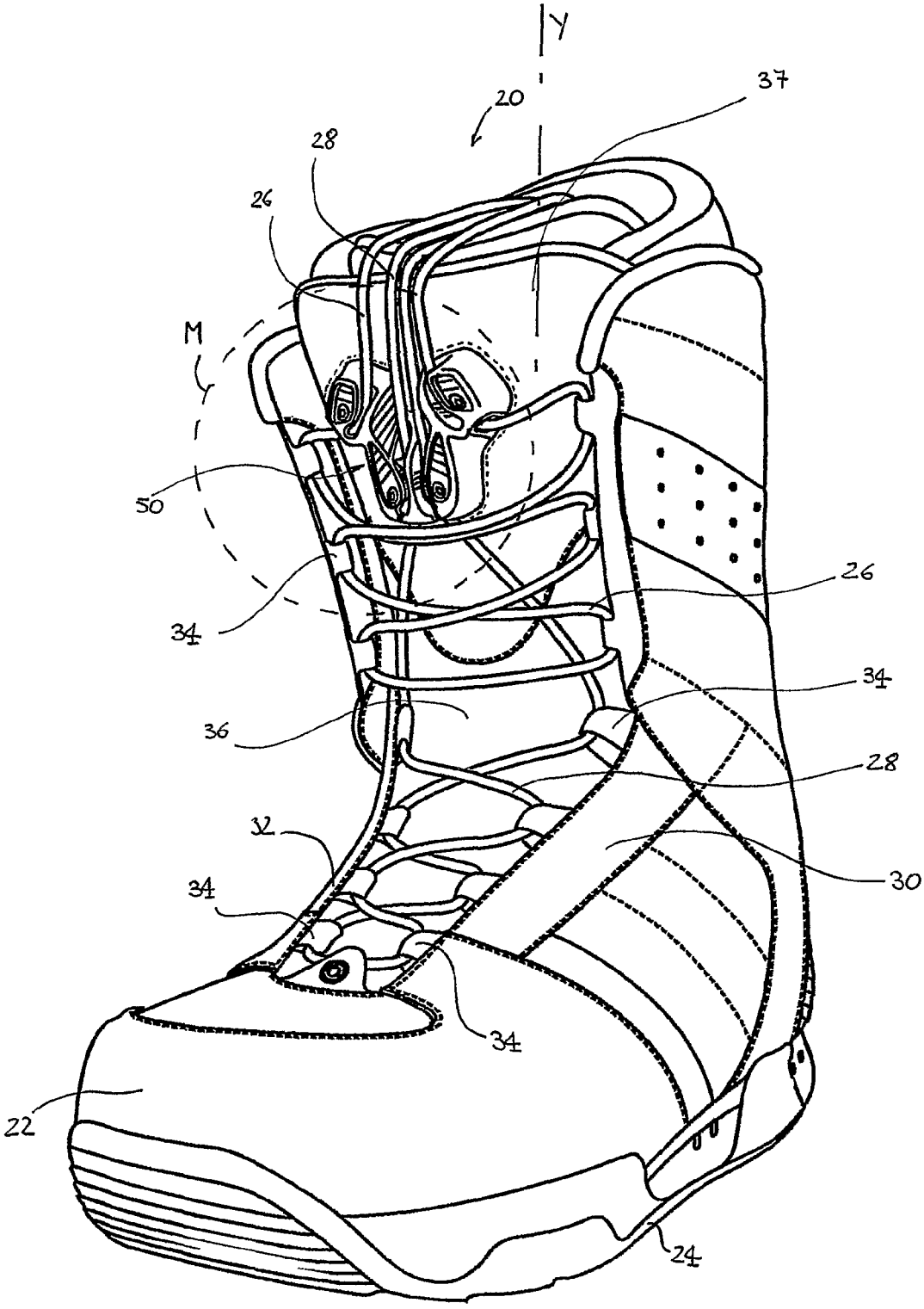
FIG. 1*a* is a three-quarter view of a boot according to the present invention.

In FIG. 1*a*, a boot according to the present invention is generally indicated at 20. This boot comprises a sole portion 24 and an upper portion 22, in which two strings 26, 28 on the front portion of the boot 20 are capable of drawing two sides 30, 32 of the same upper portion 22 closer to each other by sliding—when duly pulled—through eyelets 34 attached to the edges of said sides 30, 32, wherein only a few of such eyelets are shown in the Figure for reasons of greater simplicity.

Figure 1B:
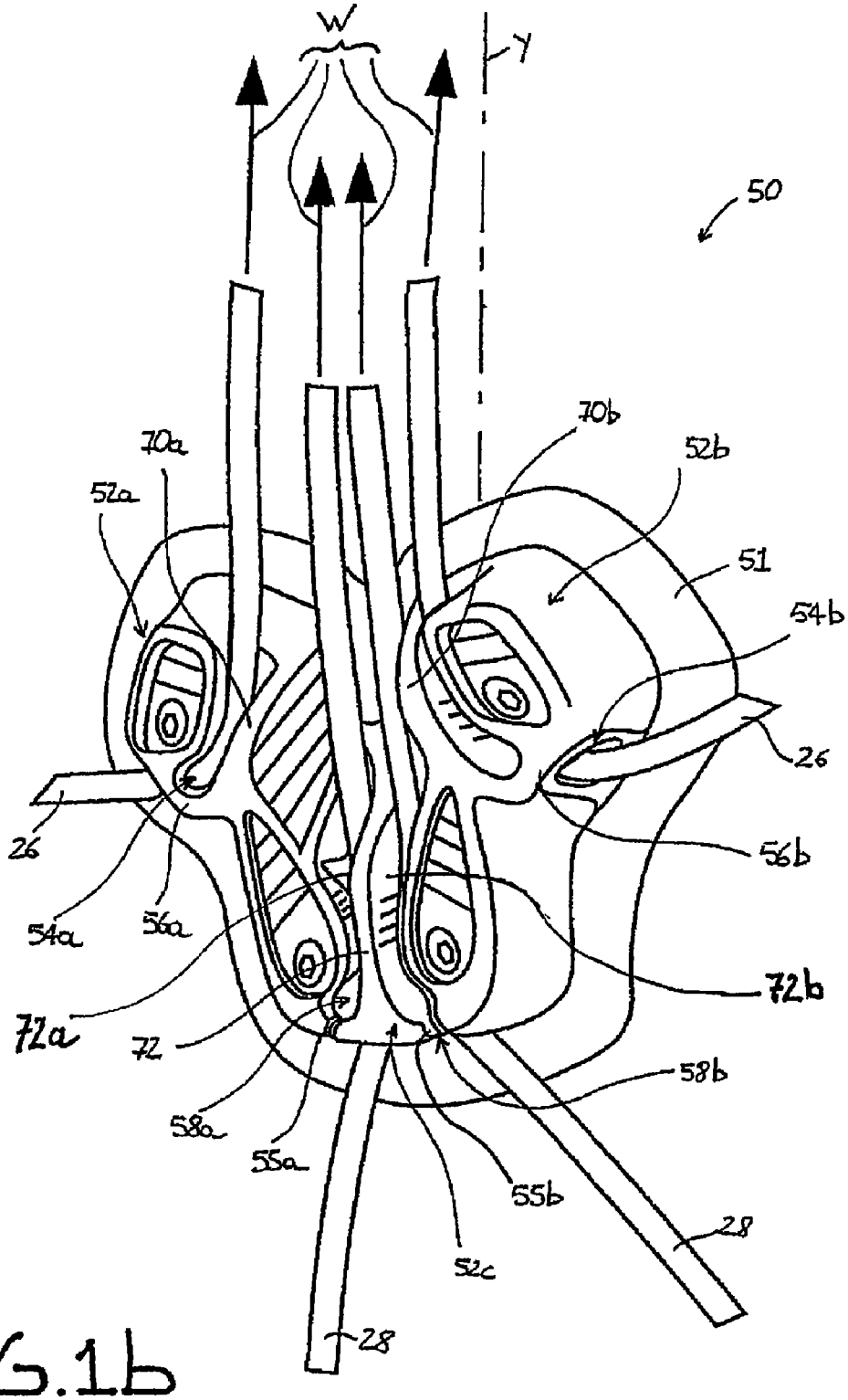
FIG. 1*b* is an enlarged view of the circle indicated at M in FIG. 1*a;*
Figure 2:
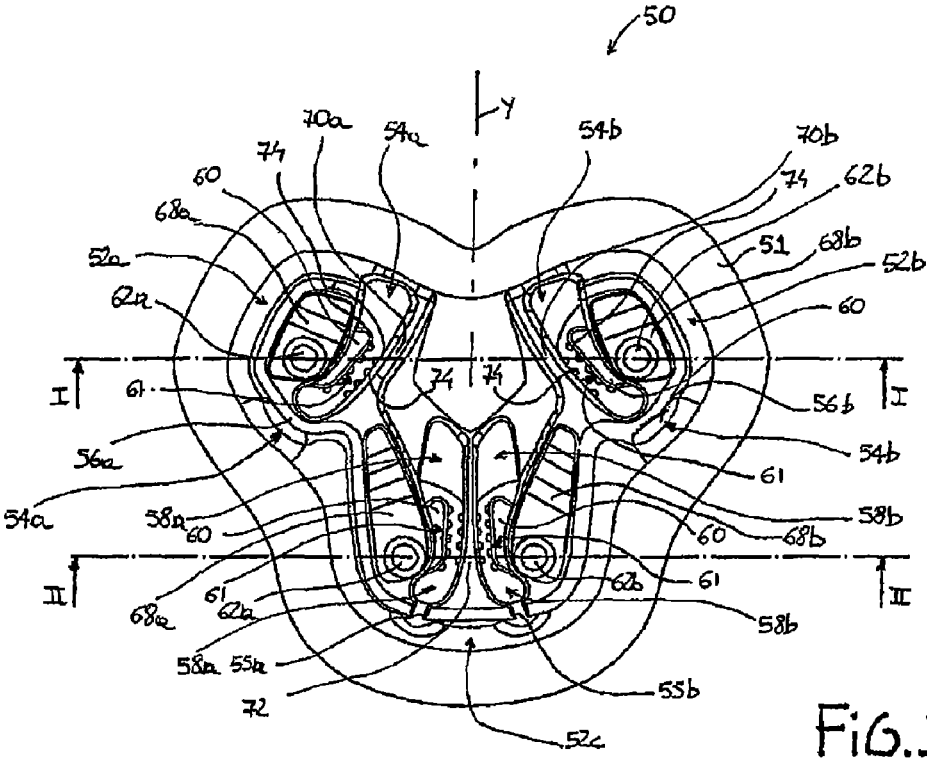
FIG. 2 is a front view of the string guide arrangement of the boot shown in FIG. 1.
Figure 3:
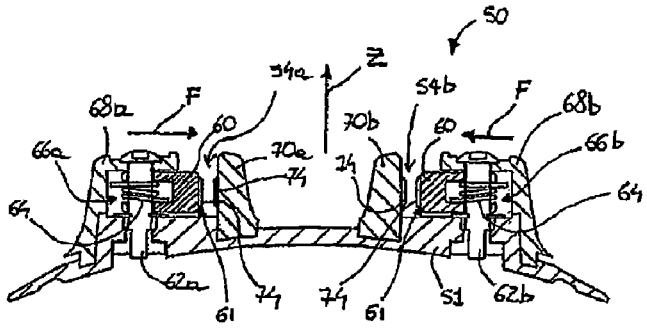
FIG. 3 is a cross-sectional view along the plane I-I of the arrangement shown in FIG. 2.
Figure 4:
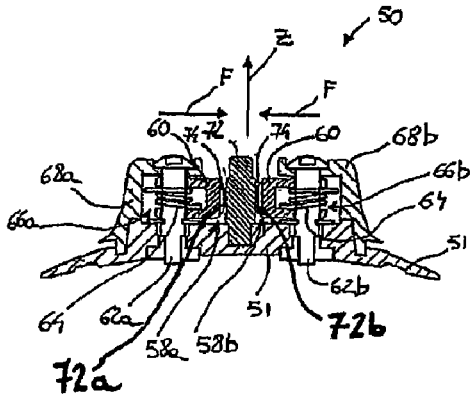
FIG. 4 is a cross-sectional view along the plane II-II of the arrangement shown in FIG. 2.

On a tongue 36 arranged under the strings 26, 28 and the sides 30, 32 so as to close the gap above the arched upper part of the foot, and having a free end portion 37 extending parallel to the leg (direction of the axis Y in FIG. 1), there is provided, in a position slightly above the ankle, a string guide locking arrangement 50 able to directionally condition some laces, which is best to be seen in FIG. 1*b*, where it appears in an enlarged view, and FIGS. 2 to 4.

The main body of such arrangement 50 rests on a slightly curved base 51, which is not to be seen in FIG. 1*a* since it lies under the tongue 36, and is in a heart-like shape with three lobes 52*a, b, c*, i.e. two upwards oriented lobes and a downwards oriented one, respectively, which are roughly arranged in the same manner as the angles of an equilateral triangle and, the upwards oriented ones, with a symmetry relative to the axis Y (a feature that will be referred to by using the suffixes "a" and "b" to indicate same and symmetrical details hereinafter). Each one of the two upwards oriented lobes 52*a, b* comprises respectively a passage 54*a* (54*b*), in which there are inserted and are capable of sliding the two end portions of the string 26. These passages 54*a* (54*b*), the bottom of which is formed by the above-cited base 51, and a side wall of which is formed by an edgeways placed, i.e. knife-like protrusion 70*a* (70*b*) departing from the base 51 itself, extend in a slightly curved pattern that tends to gradually follow the direction of the axis Y to eventually run almost parallel thereto, so that the string 26 exiting the passages 54*a* (54*b*) is guided parallel to said axis Y.

The lead-in or entry side of the passages 54*a* (54*b*) comprises a retaining staple 56*a* (56*b*), or the like, so that the string 26, even if it is let dangling, i.e. hanging loosely, is not allowed to drop onto the ground by sliding off the passages 54*a* (54*b*), but is rather sustained by said staple 56*a* (56*b*) for it to be able to be conveniently seized and taken up again.

The downwards oriented lobe 52*c* comprises two such passages 58*a* and 58*b*, in which there are inserted and are capable of sliding the two end portions of the string 28. These passages 58*a* (58*b*), the bottom of which is formed by the above-cited base 51, and a side wall of which is formed by an edgeways placed, i.e. knife-like protrusion 72 departing from the base 51 itself, extend in a manner that is almost linear and parallel to the axis Y, so that the string 28 exiting the passages 58*a* (58*b*) is guided parallel to said axis Y. Unlike the passages in the upwards oriented lobes, these passages 58*a* (58*b*) are not provided with any closing staple or similar contrivance—although they might be so provided, actually—at the entry side thereof, so that they are fully open in the cross-section thereof. Instead, a lead-in or guide nick 55*a* (55*b*) for the two end portions of the string 28 is provided at such entry side.

Along a side thereof, all such four passages 54*a*, 54*b*, 58*a*, 58*b* comprise a similar oscillating locking member 60 in the shape of a cam, which is housed in a little cavity 66*a, b* provided in the body of the arrangement 50 between the base 51 and a L-shaped covering extension 68*a, b* protruding from the same base 51, and eccentrically hinged on to a pin 62*a, b* fitted in perpendicularly to the axis Y (see FIGS. 3 and 4 for a more detailed representation, in which—as this is done throughout the following description, on the other hand—the same reference numerals are used to indicate similar parts, wherein these are solely distinguished by the use of the suffixes "a" and "b" so as to avoid making the description dull reading).

With an almost planar, flat section 61 thereof, the oscillating member 60 forms a side wall of the passages 54*a*, 54*b*,

58*a*, 58*b*, wherein this wall faces the respective, opposite side wall 70*a*, 70*b* and 72*a*, 72*b*. A plurality of teeth 74 (only a few of them being shown in the Figure for reasons of greater simplicity) are projecting—transversally relative to the lengthwise direction—from the walls 70*a*, 70*b* and 72*a*, 72*b*, as well as the flat section 61 of the oscillating members 60: owing to the geometrical arrangement of the whole assembly, the result is that, when a string is inserted in the passages 54*a*, 54*b*, 58*a*, 58*b*, the same string is in contact—on the two opposite sides thereof—with said teeth 74 centrally relative to the base 51, while the exposed portion thereof, on the opposite side relative to said base 51, is fully uncovered and free, i.e. not engaged or restrained. Moreover, the oscillating member 60 is able to rotate about the pin 62 so as to bring the teeth 74 provided along the flat section 61 thereof and the opposite side walls 70*a*, 70*b* and 72*a*, 72*b* closer to or away from each other.

As an option, connected to the pin 62 there may be spring means 64 (a helical spring in the particular case being considered) that are adapted to elastically bias the oscillating member 60 to push it against the respective opposite side wall 70*a*, 70*b*, 72*a*, 72*b*—in the direction indicated at F in the Figures.

The manner in which the arrangement 50 works will be explained below in greater detail.

The two end portions of the strings 26, 28 are inserted in the passages 54*a*, 54*b* and 58*a*, 58*b*, respectively, as this is best shown in FIG. 1. For the boot 20 to be laced up, i.e. fastened, the wearer has simply to remain standing, i.e. in an erect posture, with the boot 20 on, and pull the strings 26, 28 in a pulling direction for fastening W extending parallel to the direction of the axis Y. The sliding motion of the strings 26, 28 causes the flat section 61 to move away from the opposite side walls 70*a*, 70*b* and 72*a*, 72*b*, so that the teeth 74 provided on said walls move in turn away from each other and do not interfere with the motion of the strings 26, 28. When the tension applied on the strings 26, 28 by pulling them in this way enables the desired or preferred degree of fastening of the boot to be eventually reached, the wearer can release the strings 26, 28, which, by moving slightly backwards, i.e. in a direction opposite to the pulling or fastening one W, in each passage 54*a*, 54*b*, 58*a*, 58*b* as a reaction to them being so released, owing to the friction existing between them and the teeth 74, are able to move the respective oscillating members 60 downwards, wherein these oscillating members—as assisted by both gravity and the action of the spring means 64—move closer to and get stuck against the respective opposite side walls 70*a*, 70*b* and 72*a*, 72*b*, thereby tightening and locking in place the strings 26, 28. The residual tension of the strings 26, 28 is sufficient to keep the members 60 in position and the strings 26, 28 locked in place.

For the boot 20 to be then taken off, the fastening of the strings 26, 28 can be released in a quite simple manner, according to a feature of the present invention. To do this, in fact, the wearer has just to seize the strings 26, 28 and push them slightly forwards, towards the toe of the foot. By doing this, the strings 26, 28 are caused to slide on the teeth 74, which, owing to the geometrical shape thereof, do not oppose any resistance, and move out of the passages 54*a*, 54*b*, 58*a*, 58*b* (in the direction indicated at Z in FIGS. 3 and 4). At this point, they are no longer retained by anything, except for the staples 56*a* and 56*b*, on which they are anyway able to slide, and the fastening can be undone.

Figure 5:
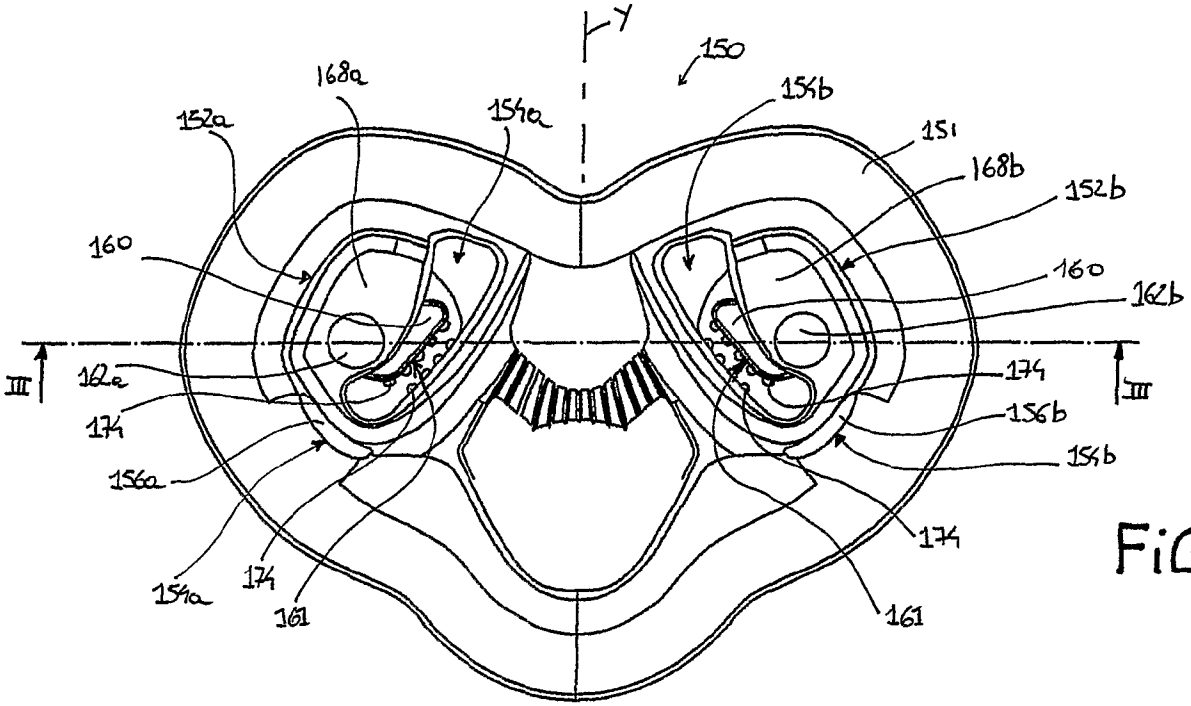
FIG. 5 is a front view of a modified embodiment of the string guide arrangement of the boot shown in FIG. 1.
Figure 6:
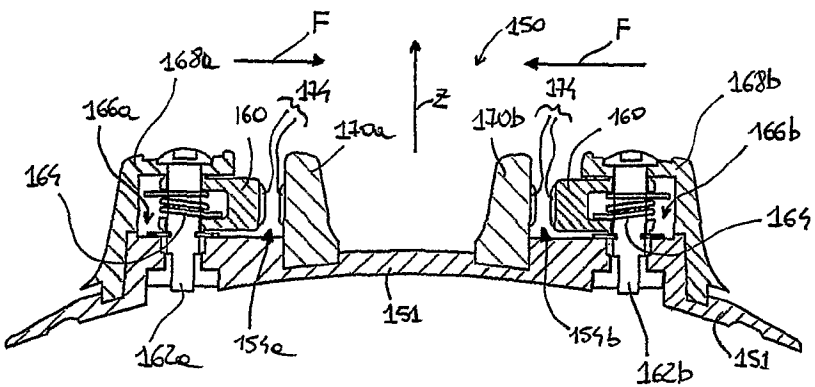
FIG. 6 is a cross-sectional view along the plane III-III of the arrangement shown in FIG. 5.

A modified embodiment of the string guide arrangement for the boot according to the present invention is illustrated in FIGS. 5 and 6, where it is generally indicated at 150 and the reference numerals used to indicate parts that are similar to those considered in connection with the previously illustrated embodiment have been left unaltered but for the addition of the prefix "1". Basically, this embodiment goes without the two passages 58*a*, 58*b* of the downwards oriented lobe 52*c* of the previously considered embodiment.

The body of the string guide arrangement 150 rests on a slightly curved base 151 and features two lobes 152*a, b* arranged symmetrically relative to the axis Y (this feature being referred to below by using the suffixes "a" and "b" to indicate similar and symmetrical parts). As in the previously considered case, each one of the two lobes 152*a, b* comprises a passage 154*a* (154*b*) in which the two end portions of the string 26 are inserted and able to slide. These passages 154*a* (154*b*), the bottom of which is formed by the above-cited base 151, extend in a slightly curved pattern that tends to gradually follow the direction of the axis Y to eventually run almost parallel thereto, so that the string 26 exiting the passages 154*a* (154*b*) is guided parallel to said axis Y. The entry side of the passages 154*a* (154*b*) comprises a retaining staple 156*a* (156*b*), or the like, so that the string 26, even if it is let dangling, i.e. hanging loosely, is not allowed to drop onto the ground, but is rather sustained by said staple 156*a* (156*b*) for it to be able to be conveniently seized and taken up again.

The inner structure of the passages 154*a* (154*b*) is made and works in the same way as this has already been described hereinbefore, so that there is no point in dealing with the related details any further. In particular, the passages 154*a*, 154*b* comprise, along a side thereof, a similar oscillating locking member 160 in the shape of a cam, which is housed in a little cavity 166*a, b* provided in the body of the arrangement 150 between the base 151 and a L-shaped covering extension 168*a, b* protruding from the same base 151, and eccentrically hinged on to a pin 162*a, b* fitted in perpendicularly to the axis Y.

With an almost planar, flat section 161 thereof, the oscillating member 160 forms a side wall of the passages 154*a*, 154*b*, wherein this wall faces the respective, opposite side wall 170*a*, 170*b*. A plurality of teeth 174 (only a few of them being shown in the Figure for reasons of greater simplicity) are projecting—transversally relative to the lengthwise direction—from the walls 170*a*, 170*b*, as well as the flat section 161 of the oscillating members 160: as in the previously considered case, the result is that, when a string is inserted in the passages 154*a*, 154*b*, the same string is in contact—on the two opposite sides thereof—with said teeth 174 centrally relative to the base 151, while the exposed portion thereof, on the opposite side relative to said base 151, is fully uncovered and unrestrained. Moreover, the oscillating member 160 is able to rotate about the pin 162 so as to bring the teeth 174 and the opposite side walls 170*a*, 170*b* closer to or away from each other.

As an option, connected to the pin 162 there may be spring means 164 (a helical spring in the particular case being considered) that are adapted to elastically bias the oscillating member 160 to push it against the respective opposite side wall 170*a*, 170*b*—in the direction indicated at F in the Figures.

Figure 7:
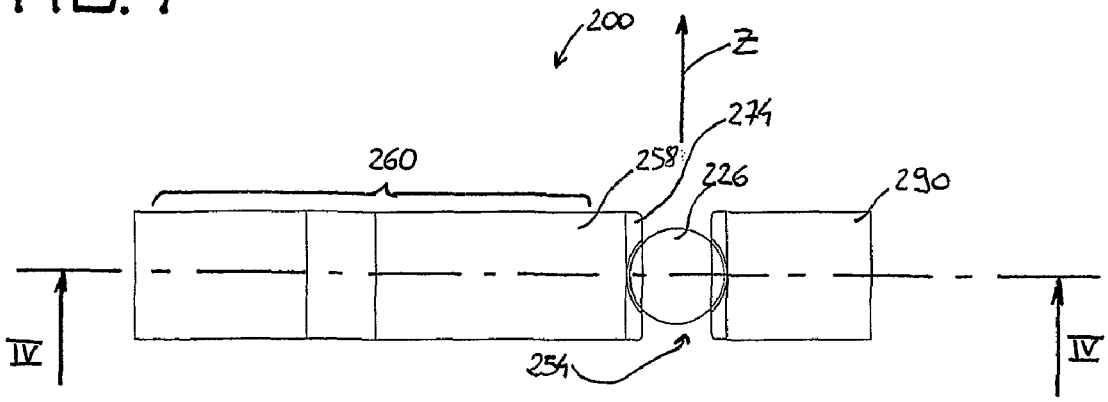
FIG. 7 is a schematical top view of a component part for the arrangement shown in FIGS. 2 and 5.
Figure 8:
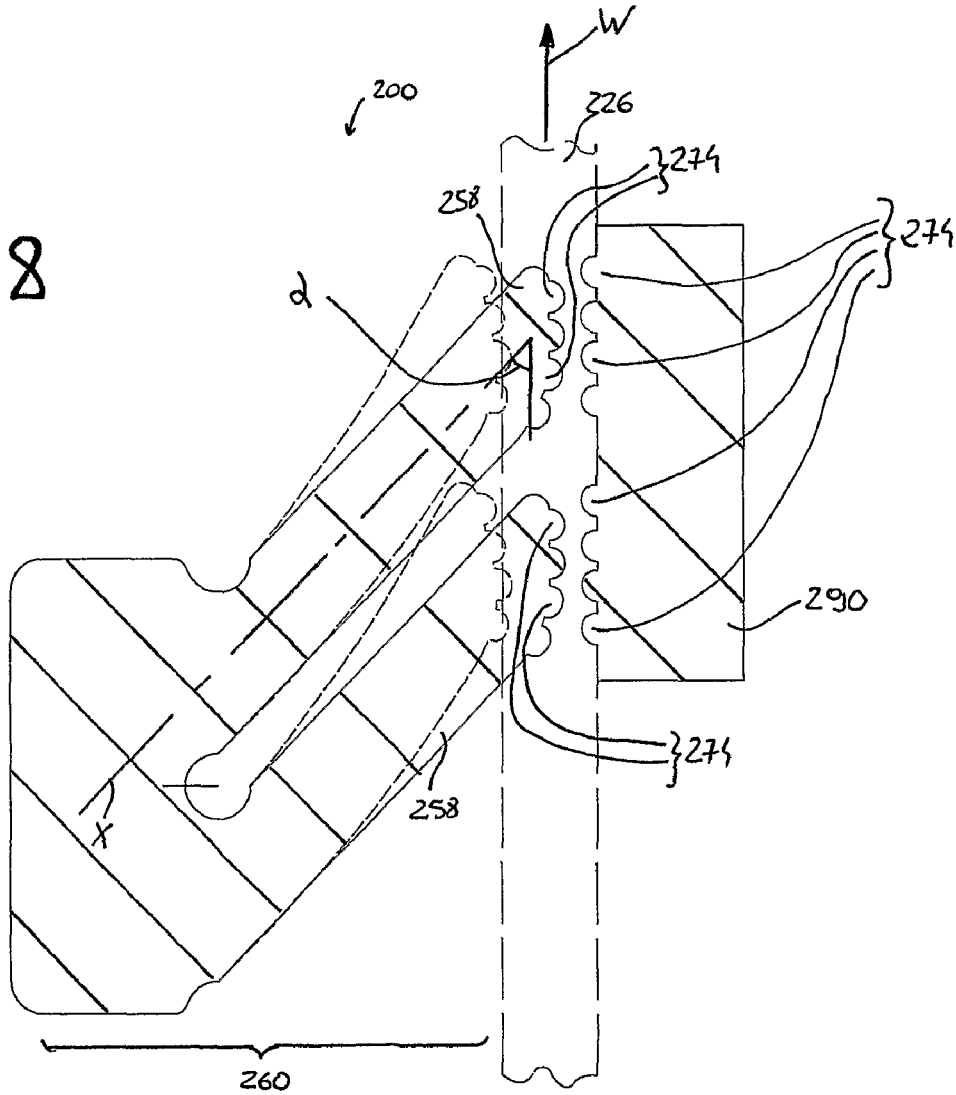
FIG. 8 is a schematical cross-sectional view along the plane IV-IV of the component part shown in FIG. 6.

A modified embodiment of a component part of the inventive string guide arrangement is illustrated schematically in FIGS. 7 and 8, where it is generally indicated at 200. Instead of the previously considered oscillating members 60, 160, which may be also replaced by other jamming or wedge-in mechanisms of different shape and construction, use can be made of an oscillating member 260 having a flexible segment 258 that, therefore, is inherently biased elastically. This flexible segment 258 has a longitudinal axis X that forms with the longitudinal axis of the string 226 an acute angle $\alpha$, wherein the vertex of the angle α roughly coincides with the point of contact between the segment 258 and the string 226. This vertex is offset, i.e. shifted relative to the member 260 towards the pulling direction W. The end portion of the segment 258 in contact with the string 226 is provided with a plurality of projecting teeth 274 (only a few of them shown in the Figures for reasons of greater simplicity) aimed at improving the grip on the string 226, and is countered by a resting wall 290 that is in turn provided with a plurality of projecting teeth 274 (only a few of them being again shown in the Figures for reasons of greater simplicity). This construction can be most easily implemented inside the passages that have been described hereinbefore in connection with the first and the second embodiment of the present invention.

The way in which the arrangement 200 works shall be now explained in detail.

The string 226 is inserted in the passage that—as indicated at 254 in the Figures—is formed between the segment 258 and the opposing wall 290. For the boot to be fastened, the wearer has at this point to just pull the string 226 in the pulling direction W. The resulting sliding motion of the string 226 causes the segment 258 to bend (into the position shown by dashed lines in FIG. 8), so that the teeth 274 no longer oppose, i.e. hinder the string 226 from sliding.

When the tension applied on the string 226 by putting it in this way enables the desired or preferred degree of fastening of the boot to be eventually reached, the wearer can release the string 226, which, by moving slightly backwards, i.e. in a direction opposite to the pulling or fastening one W, enables the segment 258 to again move against the string 226 so as to exert a pressure thereupon. Owing to the teeth 274, the segment 258 gets stuck onto the string 226 to thereby lock it in place. The residual tension of the string 226 is sufficient to keep the segment 258 in position and the string 226 locked by mutual jamming effect. When the fastening of the boot has to be loosened, a construction as the one described hereinbefore in connection with the previously considered embodiments ensures that this can be done by simply pulling the string 226 sideways in the direction Z.

It will be readily appreciated that the inventive concept as illustrated with reference to the accompanying drawings and described above byway of non-limiting example may be the subject of a number of further different embodiments, and variants thereof, without departing from the scope of the present invention as defined by the following claims.

The invention claimed is:

1. A footwear item comprising:

an upper portion that reaches up to at least the ankle of a user;

a gap opening in a front portion of the upper portion and defining two opposite edges of the gap;

at least one string or lace that runs through eyelets arranged along the edges of the gap opening up on the front of the upper portion, and that tightens up, thereby drawing the edges of said gap closer to each other, when it is pulled in a fastening direction extending parallel to the leg of the user;

a string locking arrangement, provided in the upper portion, having a main body resting on a base and being provided with one or more passages, each of the one or more passages having a bottom side, a top side and lateral sides, the bottom side of each of the one or more passages being formed by said base;

wherein said at least one string is inserted in said one or more passages and is capable of sliding when the wearer pulls it, and is retained there by locking means when it is not pulled in the fastening direction extending parallel to the leg of the user;

wherein the locking means are provided in at least one of said passages, said locking means being comprised of an oscillating locking member in contact with said at least one string, which allows said at least one string to slide when the latter is pulled in the fastening direction extending parallel to the leg of the user, and which on the contrary gets attached to said at least one string and locks it in position when the latter undergoes a tension in a direction opposite to said fastening direction;

wherein said one or more passages have a geometrical arrangement such that the top side of each of said one or more passages is open, whereby, when the string is inserted therein, the same string has its side opposite to the bottom side of the passage uncovered, so that it is possible for the user to release the fastening of the string by seizing the string and pushing it forward, towards the toe of the foot, causing the string to move out of said one or more passages;

wherein the main body is in a heart-like shape with three lobes, comprising two upwards oriented lobes and a downwards oriented lobe, respectively, which are roughly arranged as the angles of an equilateral triangle, the upwards oriented lobes comprising at least one passage each; and wherein the downwards oriented lobe comprises at least two passages, each of the at least two passages having a bottom formed by the base and a sidewall thereof formed by an edgeways placed, knife-like protrusion belonging to the lobe.

2. The footwear item according to claim 1, wherein said oscillating locking member is biased elastically.

3. The footwear item according to claim 1, wherein said oscillating locking member comprises projecting teeth.

4. The footwear item according to claim 3, wherein said oscillating locking member includes a planar section extending in a lengthwise direction and wherein the projecting teeth are provided transversally relative to this lengthwise direction.

5. The footwear item according to claim 1, wherein at least one passage comprises on the side thereof said oscillating locking member, which is housed in a cavity provided between the base and a covering extension of the string locking arrangement.

6. The footwear item according to claim 1, wherein the bottom of at least one passage is formed by the base and a side wall thereof is formed by an edgeways placed, knife-like protrusion belonging to the string guide arrangement.

7. The footwear item according to claim 1, wherein at least one passage extends in a slightly curved pattern that tends to gradually follow a direction of an axis that is substantially parallel to the leg of the person wearing the footwear item.

8. The footwear item according to claim 1, wherein said one or more passages in the main body of the string locking arrangement each have an entry side, at which said at least one string is inserted into the passages and wherein the entry side of at least one passage comprises a retaining member, so that said at least one string, even if it is let hanging loosely, is not allowed to drop by sliding off said at least one passage.

9. The footwear item according to claim 1, wherein said retaining member is comprised of a closing staple.

10. The footwear item according to claim 1, wherein the oscillating locking member comprises a substantially flat section that forms a side wall of at least one passage.

11. The footwear item according to claim 1, wherein a plurality of projecting teeth are provided on side walls of at least one passage.

12. The footwear item according to claim 1, wherein said teeth are provided projecting from the side walls in a position opposite to the oscillating locking member.

13. The footwear item according to claim 1, wherein the oscillating locking member is hinged eccentrically on to a pin that is fitted perpendicularly to the base of the string locking arrangement.

14. The footwear item according to claim 13, wherein the oscillating locking member is biased elastically by spring means.

15. The footwear item according to claim 14, wherein said spring means are secured to the pin.

16. The footwear item according to claim 1, wherein the footwear item is a boot with the upper portion reaching up beyond the ankle and has frontally, over the foot, the gap opening comprising an aperture whose side edges are capable of being drawn closer to each other by means of the at least one string.

* * * * *